US010438526B2

(12) United States Patent
Kim et al.

(10) Patent No.: US 10,438,526 B2
(45) Date of Patent: Oct. 8, 2019

(54) DISPLAY DRIVER, AND DISPLAY DEVICE AND SYSTEM INCLUDING THE SAME

(71) Applicant: SAMSUNG ELECTRONICS CO., LTD., Suwon-si (KR)

(72) Inventors: Yang Hyo Kim, Suwon-si (KR); Do Kyung Kim, Yongin-si (KR); Soo Young Woo, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 365 days.

(21) Appl. No.: 15/215,803

(22) Filed: Jul. 21, 2016

(65) Prior Publication Data

US 2017/0025055 A1 Jan. 26, 2017

(30) Foreign Application Priority Data

Jul. 21, 2015 (KR) ..... 10-2015-0102894

(51) Int. Cl.
*G09G 5/02* (2006.01)
*G09G 3/20* (2006.01)

(52) U.S. Cl.
CPC ..... *G09G 3/2003* (2013.01); *G09G 2310/08* (2013.01); *G09G 2320/0666* (2013.01); *G09G 2320/0686* (2013.01); *G09G 2330/021* (2013.01); *G09G 2340/06* (2013.01)

(58) Field of Classification Search
CPC ..... G09G 2340/06; G09G 3/2003; G09G 2320/0686; G09G 2320/0666; G09G 2320/021; G09G 2310/08
See application file for complete search history.

(56) References Cited

U.S. PATENT DOCUMENTS

| | | | | |
|---|---|---|---|---|
| 7,027,056 | B2 | 4/2006 | Koselj et al. | |
| 7,095,391 | B2 | 8/2006 | Lee | |
| 7,317,459 | B2 | 1/2008 | Fouladi et al. | |
| 8,633,887 | B2 | 1/2014 | Lim | |
| 8,823,627 | B2 | 9/2014 | Kudo et al. | |
| 2002/0145745 | A1 | 10/2002 | Kanno | |
| 2007/0139403 | A1 | 6/2007 | Chung | |
| 2007/0285428 | A1 | 12/2007 | Foster et al. | |
| 2010/0214315 | A1* | 8/2010 | Nguyen | G09G 5/06 345/603 |

(Continued)

FOREIGN PATENT DOCUMENTS

| | | | |
|---|---|---|---|
| KR | 2002-0050018 | A | 6/2002 |
| KR | 10-2005-0000012 | A | 1/2005 |

*Primary Examiner* — Nelson M Rosario
*Assistant Examiner* — Andrew Lee
(74) *Attorney, Agent, or Firm* — Sughrue Mion, PLLC

(57) ABSTRACT

A display driver and a display device and system including the same are provided. The display driver includes an interface circuit configured to receive image data from a host; a graphics memory configured to store m-bit data per pixel corresponding to the received image data, where m being an integer greater than zero; a color converter configured to convert the m-bit data per pixel stored in the graphics memory into n-bit data per pixel and to output n-bit converted data, n being an integer greater than m; a selector configured to selectively output one among the n-bit converted data and the image data received from the host; and a source driver configured to drive a display panel based on output data of the selector.

19 Claims, 14 Drawing Sheets

(56) References Cited

U.S. PATENT DOCUMENTS

| | | | | |
|---|---|---|---|---|
| 2011/0279466 | A1* | 11/2011 | Park | G09G 3/3648 345/581 |
| 2012/0188265 | A1* | 7/2012 | Suzuki | G09G 5/06 345/589 |
| 2013/0021229 | A1 | 1/2013 | Ludden et al. | |
| 2013/0201223 | A1* | 8/2013 | Li | G09G 3/2022 345/690 |
| 2014/0146064 | A1 | 5/2014 | Seetharamaiah et al. | |

* cited by examiner

FIG. 8A

| | | | | | |
|---|---|---|---|---|---|
| R | 00 | 00 | FF | FF | 00 |
| G | 00 | 00 | 99 | FF | 00 |
| B | 00 | 00 | 00 | FF | 00 |

FIG. 8B

| | | | |
|---|---|---|---|
| 00 | 00 | 01 | 11 | 00 |

FIG. 8C

| | | | | | |
|---|---|---|---|---|---|
| R | 00 | 00 | FF | FF | 00 |
| G | 00 | 00 | 99 | FF | 00 |
| B | 00 | 00 | 00 | FF | 00 |

FIG. 10A

| GDAT | FCDAT | | |
|---|---|---|---|
| | R | G | B |
| 1 | R1 | G1 | B1 |
| 0 | R2 | G2 | B2 |

FIG. 10B

| Area | GDAT | FCDAT | | |
|---|---|---|---|---|
| | | R | G | B |
| 1 | 1 | R11 | G11 | B11 |
| | 0 | R12 | G12 | B12 |
| 2 | 1 | R21 | G21 | B21 |
| | 0 | R22 | G22 | B22 |

FIG. 10C

| GDAT | FCDAT | | |
|---|---|---|---|
| | R | G | B |
| 11 | FF | FF | FF |
| 00 | 00 | 00 | 00 |
| else | FF | 99 | 00 |

FIG. 10D

| Time | GDAT | FCDAT | | |
|---|---|---|---|---|
| | | R | G | B |
| 1 | 1 | R11 | G11 | B11 |
| | 0 | R12 | G12 | B12 |
| 2 | 1 | R21 | G21 | B21 |
| | 0 | R22 | G22 | B22 |

DISPLAY DRIVER, AND DISPLAY DEVICE AND SYSTEM INCLUDING THE SAME

CROSS-REFERENCE TO RELATED APPLICATION

This application claims priority under 35 U.S.C. § 119(a) from Korean Patent Application No. 10-2015-0102894 filed on Jul. 21, 2015, the disclosure of which is hereby incorporated by reference in its entirety.

BACKGROUND

Apparatuses and methods consistent with exemplary embodiments relate to a display device, and more particularly, to a display driver for driving a display panel, and a display device and system including the same.

A display driver integrated circuit (IC) is required to control and drive a display panel in a liquid crystal display (LCD), a light emitting diode (LED) display, an organic LED (OLED) display, or an active-matrix OLED (AMOLED) display. A display driver which does not include graphics random access memory (GRAM) is favored for low-price display devices or systems including the same (e.g., low-price mobile products) in order to secure a competitive price. However, when a display driver does not include GRAM, a host needs to continuously transmit image data to a display device, which results in increased system power consumption. Meanwhile, when a display driver includes GRAM, even if the display driver uses large-capacity GRAM to display a simple pattern or display an image in a small area of a display screen, power loss occurs.

SUMMARY

According to an aspect of an exemplary embodiment, there is provided a display driver including: an interface circuit configured to receive image data from a host; a graphics memory configured to store m-bit data per pixel corresponding to the received image data, m being an integer greater than zero; a color converter configured to convert the m-bit data per pixel stored in the graphics memory into n-bit data per pixel and to output n-bit converted data, n being an integer greater than m; a selector configured to selectively output one among the n-bit converted data and the image data received from the host; and a source driver configured to drive a display panel based on output data of the selector.

The display driver may further include a register configured to store a register setting. The color converter is further configured to convert the n-bit data according to the register setting.

The color converter may be further configured to output first predetermined RGB data as the n-bit converted data in response to the m-bit data per pixel being one, and output second predetermined RGB data as the n-bit converted data in response to the m-bit data per pixel being zero.

The integer m may be one; and the color converter may be further configured to output first predetermined RGB data as the n-bit converted data in response to the m-bit data per pixel being one and corresponding to a first area, output second predetermined RGB data as the n-bit converted data in response to the m-bit data per pixel being one and corresponding to a second area, output third predetermined RGB data as the n-bit converted data in response to the m-bit data per pixel being zero and corresponding to the first area, and output fourth predetermined RGB data as the n-bit converted data in response to the m-bit data per pixel being zero and corresponding to the second area.

The display driver may further include a register configured to store at least one conversion data set which defines a mapping between the m-bit data per pixel and the n-bit converted data.

The display driver may be further configured to change the at least one conversion data set in the register in response to receiving a register setting command from the host.

The at least one conversion data set may include a first conversion data set of a plurality of conversion data sets corresponding to a first area of a plurality of display areas and a second conversion data set of the plurality of conversion data sets corresponding to a second area of the plurality of display areas.

The at least one conversion data set may include a first conversion data set of a plurality of conversion data corresponding to a first time period of a plurality of time periods and a second conversion data set of the plurality of conversion data sets corresponding to a second time period of the plurality of time periods The register further may be further configured to store: a color mode field indicating a number of bits per pixel in the image data; and a color programming field indicating whether the at least one conversion data set can be changed.

The number of bits per pixel in the image data may be n in response to the color mode field being set to a first color mode value, and the number of bits per pixel in the image data may be m in response to the color mode field being set to a second color mode value.

The display driver may further include a pixel encoder configured to encode the n-bit data per pixel image data into the m-bit data per pixel according to a predetermined encoding rule.

According to an aspect of another exemplary embodiment, there is provided a display device including: a display panel configured to display an image signal; and a display driver configured to drive the display panel, the display driver comprising an interface circuit configured to receive image data having at least one bit per pixel from a host, a converted data generator configured to generate n-bit converted data per pixel based on at least one conversion data set which defines a mapping between m-bit data and n-bit data, m being an integer greater than zero and n being an integer greater than m, and a source driver configured to drive the display panel based on data selected from among the received image data and the converted data. A first conversion data set of the at least one conversion data set corresponds to one among a first time period of a plurality of time periods and a first display area of a plurality of display areas.

The display driver may further include a register configured to store a plurality of conversion data sets, each of the plurality of conversion data sets corresponding to one among the plurality of time periods and the plurality of display areas.

A conversion data set of the plurality of conversion data sets may be changed according to a register setting command of the host.

The converted data generator may include: a graphics memory configured to store the m-bit data per pixel; and a color converter configured to convert the m-bit data per pixel data into the n-bit converted data per pixel converted data according to a conversion data set of the plurality of conversion data sets.

The converted data generator may further include a pixel encoder configured to encode the n-bit data per pixel image data received by the interface circuit into the m-bit data per pixel according to a predetermined encoding rule.

The integer m may be one among one and two.

The plurality of display areas may include the first area and a second area, and the register may be further configured to store the first conversion data set corresponding to the first area and a second conversion data set corresponding to the second area.

According to an aspect of yet another exemplary embodiment, there is provided an electronic system including: a display device configured to display an image signal; and a system-on-chip (SoC) configured to control the display device. The display device includes: an interface circuit configured to sequentially receive frame by frame image data from the SoC; a graphics memory configured to store m-bit data per pixel corresponding to the received image data; a color converter configured to output converted data having n bits per pixel based on at least one conversion data set which defines a mapping between m-bit data and n-bit data, m being an integer greater than zero and n being an integer greater than m; and a source driver configured to drive the display panel based on data selected from among the received image data and the converted data. A first conversion data set of the at least one conversion data set corresponds to one among a first time period and a first display area of a plurality of display areas.

The display device may further include a register configured to store the at least one conversion data set.

The SoC may be further configured to issue a register setting command to the display device, and the display device may be further configured to change the conversion data set stored in the register in response to the register setting command.

The display device may further include a pixel encoder configured to encode the received frame by frame image data into the m-bit data per pixel.

According to an aspect of still another exemplary embodiment, there is provided a method of operating a display device connected to a system-on-chip (SoC), the method including: setting a first conversion data set defining a first mapping between m-bit data and n-bit data in a register of the display device, m being an integer greater than zero and n being an integer greater than m; receiving first frame data from the SoC; storing m-bit data per pixel in graphics memory based on the first frame data; converting the m-bit data per pixel stored in the graphics memory into first converted data having n bits per pixel based on the first conversion data set; and driving a display panel based on the first converted data.

The method may further include: changing the first conversion data set to a second conversion data set defining a second mapping between m-bit data and n-bit data in the register of the display device in response to a register setting command from the SoC; receiving second frame data from the SoC; storing m-bit data per pixel in the graphics memory based on the second frame data; converting the m-bit data per pixel stored in the graphics memory into second converted data having n bits per pixel based on the second conversion data set; and driving the display panel based on the second converted data.

The method may further include transmitting a reference signal to the SoC. The first frame data and the second frame data may be transmitted from the SoC to the display device according to the reference signal.

According to an aspect of another exemplary embodiment, there is provided a display driver including: an interface circuit configured to receive image data from a host; a graphics memory configured to store m-bit data per pixel corresponding to the received image data, m being an integer greater than zero; a color converter configured to convert the m-bit data per pixel stored in the graphics memory into n-bit data per pixel and to output n-bit converted data, n being an integer greater than m; a selector configured to selectively output one among the n-bit converted data and the image data received from the host; a data processor configured to perform image processing on output data of the selector and generate a processed image signal; and a source driver configured to drive a display panel based on the processed image signal.

The display driver may further include a pixel encoder configured to encode the n-bit data per pixel image data from the graphics memory into the m-bit data per pixel according to a predetermined encoding rule and output the m-bit data per pixel to the color converter.

BRIEF DESCRIPTION OF THE DRAWINGS

The above and other features and advantages of the inventive concept will become more apparent by describing in detail exemplary embodiments thereof with reference to the attached drawings in which:

FIGS. 8A through 8C are diagrams for explaining the operation of the converted data generator illustrated in FIG. 7 according to one or more exemplary embodiments;

FIGS. 10A through 10D are tables of conversion data sets according to one or more exemplary embodiments;

DETAILED DESCRIPTION OF EXEMPLARY EMBODIMENTS

Figure 1:
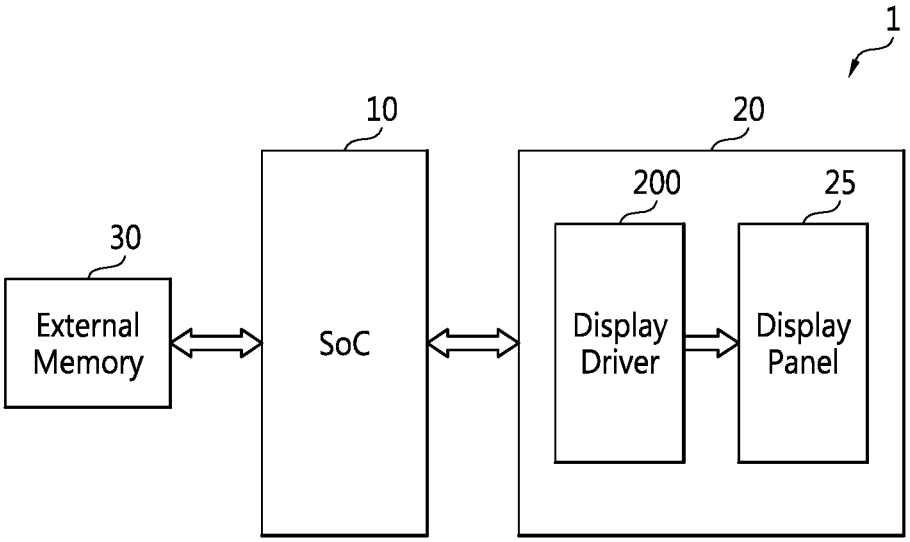
FIG. 1 is a block diagram of an electronic system including a semiconductor integrated circuit (IC) according to one or more exemplary embodiments.

Methods and apparatuses consistent with exemplary embodiments will be described more fully hereinafter with reference to the accompanying drawings, in which exemplary embodiments are shown. Exemplary embodiments, however, may be embodied in many different forms and should not be construed as limited to the exemplary embodiments set forth herein. Rather, these exemplary embodiments are provided so that this disclosure will be thorough and complete, and will fully convey the scope to those skilled in the art. In the drawings, the size and relative sizes of layers and regions may be exaggerated for clarity. Like numbers refer to like elements throughout.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. It will also be understood that when a layer is referred to as being "on" another layer or substrate, it can be directly on the other layer or substrate, or intervening layers may also be present.

It will be understood that, although the terms first, second, etc. may be used herein to describe various elements, these elements should not be limited by these terms. These terms are only used to distinguish one element from another. For example, a first signal could be termed a second signal, and, similarly, a second signal could be termed a first signal without departing from the teachings of the disclosure.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. The term "and/or" includes any and all combinations of one or more of the associated listed items and may be abbreviated as "/".

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

Figure 2:
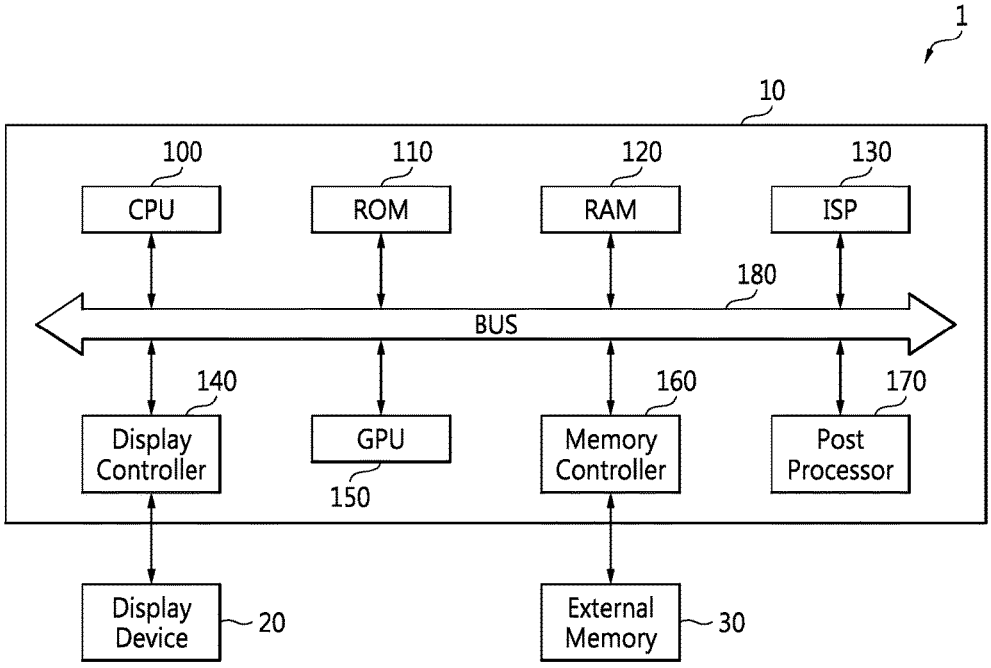
FIG. 2 is a block diagram of a system-on-chip (SoC) illustrated in FIG. 1 according to one or more exemplary embodiments.

FIG. 1 is a block diagram of an electronic system 1 including a semiconductor integrated circuit (IC) according to one or more exemplary embodiments. The semiconductor IC may be implemented as a system-on-chip (SoC) 10. FIG. 2 is a block diagram of the SoC 10 illustrated in FIG. 1 according to one or more exemplary embodiments.

Referring to FIGS. 1 and 2, the electronic system 1 may be implemented as a portable electronic device. The portable electronic device may be a laptop computer, a cellular phone, a smart phone, a tablet personal computer (PC), a personal digital assistant (PDA), an enterprise digital assistant (EDA), a digital still camera, a digital video camera, a portable multimedia player (PMP), a mobile internet device (MID), a wearable computer, an internet of things (IoT) device, or an internet of everything (IoE) device. The electronic system 1 may display a still image signal (or a still image) or a moving image signal (or a moving image) on a display panel 25.

A display device 20 includes a display driver 200 and the display panel 25. The SoC 10 and the display driver 200 may be formed together in a single module, a single SoC, or a single package such as a multi-chip package. Alternatively, the display driver 200 and the display panel 25 may be formed together in a single module.

The display driver 200 controls the operation of the display panel 25 according to signals output from the SoC 10. For instance, the display driver 200 may transmit image data received from the SoC 10 as an output image signal to the display panel 25 through a selected interface.

The display panel 25 may display an output image signal of the display driver 200. The display panel 25 may be a liquid crystal display (LCD) panel, a light emitting diode (LED) display panel, an organic LED (OLED) display panel, or an active-matrix OLED (AMOLED) display panel.

The external memory 30 stores program instructions executed by the SoC 10. The external memory 30 may also store image data used to display still images or a moving image on the display device 20. The moving image is a sequence of different still images presented in a short period of time.

The external memory 30 may be formed of volatile or non-volatile memory. The volatile memory may be dynamic random access memory (DRAM), static RAM (SRAM), thyristor RAM (T-RAM), zero capacitor RAM (Z-RAM), or twin transistor RAM (TTRAM). The non-volatile memory may be electrically erasable programmable read-only memory (EEPROM), flash memory, magnetic RAM (MRAM), phase-change RAM (PRAM), or resistive memory.

The SoC 10 controls the external memory 30 and/or the display device 20. The SoC 10 may be referred to as an IC, a processor, an application processor, a multimedia processor, or an integrated multimedia processor. The SoC 10 may include a central processing circuit (CPU) 100, a read-only memory (ROM) 110, a random access memory (RAM) 120, an image signal processor (ISP) 130, a display controller 140, a graphics processing unit (GPU) 150, a memory controller 160, a post processor 170, and a system bus 180. The SoC 10 may also include other elements apart from those elements illustrated in FIG. 2.

The CPU 100, which may be referred to as a processor, may process or execute programs and/or data stored in the external memory 30. For instance, the CPU 100 may process or execute the programs and/or the data in response to an operating clock signal output from a clock signal module. The CPU 100 may be implemented as a multi-core processor. The multi-core processor is a single computing component with two or more independent actual processors (referred to as cores). Each of the processors reads and executes program instructions.

The CPU 100 runs an operating system (OS). The OS may manage resources (such as memory and display) of the electronic system 1. The OS may distribute the resources to applications executed in the electronic system 1.

Programs and/or data stored in the ROM 110, the RAM 120, and/or the external memory 30 may be loaded to a memory in the CPU 100 when necessary. The ROM 110 may store permanent programs and/or data. The ROM 110 may be implemented as erasable programmable ROM (EPROM) or EEPROM.

The RAM 120 may temporarily store programs, data, or instructions. The programs and/or data stored in the memory 110 or 30 may be temporarily stored in the RAM 120 according to the control of the CPU 100 or a booting code stored in the ROM 110. The RAM 120 may be implemented as DRAM or SRAM.

The ISP 130 may perform various kinds of image signal processing. The ISP 130 may process image data received from an image sensor. For instance, the ISP 130 may perform shake correction and adjust white balance on the image data received from the image sensor. The ISP 130 may also perform color correction in terms of brightness or contrast, color harmony, quantization, color conversion into a different color space, and so on. The ISP 130 may periodically store the processed image data in the external memory 30 via the system bus 180.

The GPU 150 may read and execute program instructions involved in graphics processing. For instance, the GPU 150 may process graphical figures at a high speed. The GPU 150 may also convert data read by the memory controller 160 from the external memory 30 into a signal suitable to the display device 20. Apart from the GPU 160, a graphics engine or a graphics accelerator may also be used for graphics processing.

The post processor 170 may perform post processing on an image or an image signal to be suitable to an output device (e.g., the display device 20). The post processor 170 may enlarge, reduce, or rotate an image to be suitable for output. The post processor 170 may store the post-processed image data in the external memory 30 via the system bus 180 or may directly output the post-processed image to the display controller 140 on the fly.

The memory controller 160 interfaces with the external memory 30. The memory controller 160 controls the overall operation of the external memory 30 and controls data exchange between a host and the external memory 30. For instance, the memory controller 160 may write data to or read data from the external memory 30 at the request of the host. Here, the host may be a master device such as the CPU 100, the GPU 150, or the display controller 140. The memory controller 160 may read image data from the external memory 30 and provide the image data for the display controller 140 in response to an image data request of the display controller 140.

The display controller 140 controls the operations of the display device 20. The display controller 140 receives image data to be displayed on the display device 20 via the system bus 180, converts the image data into a signal (e.g., a signal complying with an interface standard) for the display device 20, and transmits the signal to the display device 20. The display controller 140 may transmit image data to the display device 20 according to the mobile industry processor interface (MIPI®) D-PHY standard, embedded DisplayPort (eDP), or low voltage differential signaling (LVDS), but exemplary embodiments are not restricted to these examples. The display controller 140 may request frame data from the memory controller 160 at a predetermined interval and receive image data frame by frame.

The elements 100, 110, 120, 130, 140, 150, 160, and 170 may communicate with one another via the system bus 180. In other words, the system bus 180 connects to each of the elements 100, 110, 120, 130, 140, 150, 160, and 170, functioning as a passage for data transmission between elements. The system bus 180 may also function as a passage for transmission of a control signal between elements.

The system bus 180 may include a data bus for transmitting data, an address bus for transmitting an address signal, and a control bus for transmitting a control signal. The system bus 180 may include a small-scale bus, i.e., an interconnector for data communication between predetermined elements.

Figure 3A:
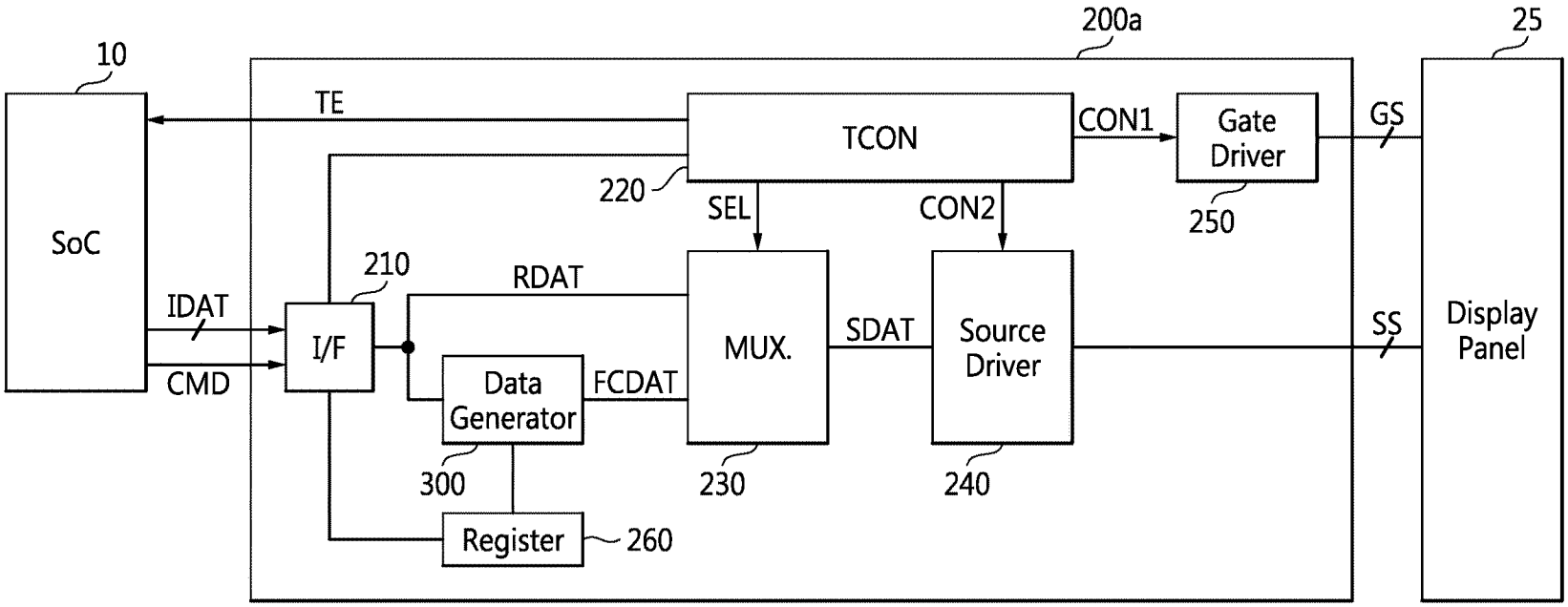
FIG. 3A is a block diagram of a display driver illustrated in FIG. 1 according to one or more exemplary embodiments.

FIG. 3A is a block diagram of an example 200*a* of the display driver 200 illustrated in FIG. 1. Referring to FIGS. 1 and 3A, the display driver 200*a* includes an interface circuit (I/F) 210, a converted data generator 300, a timing controller (TCON) 220, a selector 230, a source driver 240, a gate driver 250, and a register 260.

The interface circuit 210 receives image data IDAT from a host, i.e., the SoC 10. The image data IDAT may be transmitted frame by frame from the SoC 10 to the interface circuit 210. The image data IDAT may include at least one bit per pixel, but the number of bits per pixel may be changed according to a color mode. For instance, the image data IDAT may be n-bit-per-pixel data or m-bit-per-pixel data, where "n" is an integer of at least 2 and "m" is an integer of at least 1 and less than "n".

The converted data generator 300 outputs converted data FCDAT based on data RDAT received from the SoC 10. The received data RDAT is of the same content as the image data IDAT but may have a different format or standard than the image data IDAT.

The converted data generator 300 may store the whole or part of the received data RDAT and may convert stored data into the converted data FCDAT. In detail, the data generator 300 may encode the received data RDAT into m-bit-per-pixel data, store the encoded data, convert the encoded data into the converted data FCDAT, and output the converted data FCDAT. The structure and operations of the converted data generator 300 will be described in detail later.

The selector 230 selects and outputs either the converted data FCDAT or the received data RDAT according to a selection signal SEL. The selector 230 may be implemented as a multiplexer (MUX) or a switching circuit. The source driver 240 outputs source data SS to a plurality of source lines of the display panel 25 based on output data SDAT of the selector 230.

The position of the selector 230 may be changed. For instance, the selector 230 may be placed behind the interface circuit 210, i.e., in front of the converted data generator 300 to selectively output the received data RDAT to the source driver 240 or the converted data generator 300 according to the operating mode of the display device 20 or the electronic system 1. For instance, the converted data generator 300 may be disabled and the selector 230 may output the received data RDAT to the source driver 240 in a first operating mode. The converted data generator 300 may be enabled and the selector 230 may output the received data RDAT to the converted data generator 300 in a second operating mode. The operating mode may be determined or set by the SoC 10.

The display panel 25 may include a plurality of source lines (referred to as "data lines"), a plurality of gate lines, and a plurality of pixels. Each of the pixels may be connected to one of the source lines and one of the gate lines. The display panel 25 may be a thin film transistor LCD (TFT-LCD) panel, an LED display panel, or an OLED display panel, but exemplary embodiments are not restricted to these examples.

The timing controller 220 may generate a plurality of control signals including a first control signal CON1 and a second control signal CON2. The timing controller 220 may transmit a reference signal TE for transmission of the image data IDAT to the SoC 10. The reference signal TE will be described with reference to FIG. 11 later.

The gate driver 250 may sequentially drive the gate lines in response to the first control signal CON1. The first control signal CON1 may be a signal for instructing the gate driver 250 to start the scanning of the gate lines. The gate driver 250 may sequentially output a gate driving signal GS to the gate lines.

The source driver 240 may output the source driving signal SS for driving the source lines of the display panel 25 in response to the second control signal CON2 from the timing controller 220 and the output data SDAT.

The register 260 stores values needed by the converted data generator 300 to generate the converted data FCDAT.

The SoC 10 transmits a command CMD for controlling the operation of the display driver 200*a*. The command CMD includes a register setting command for setting the register 260. The interface circuit 210 may set the register 260 in response to the register setting command issued from the SoC 10.

The command CMD may be transmitted through the same channel as or a different channel than the image data IDAT. The display driver 200*a* may transmit a response to the command CMD to the SoC 10. A channel for transmitting the image data IDAT and/or the command CMD may be a full- or half-duplex channel.

Figure 3B:
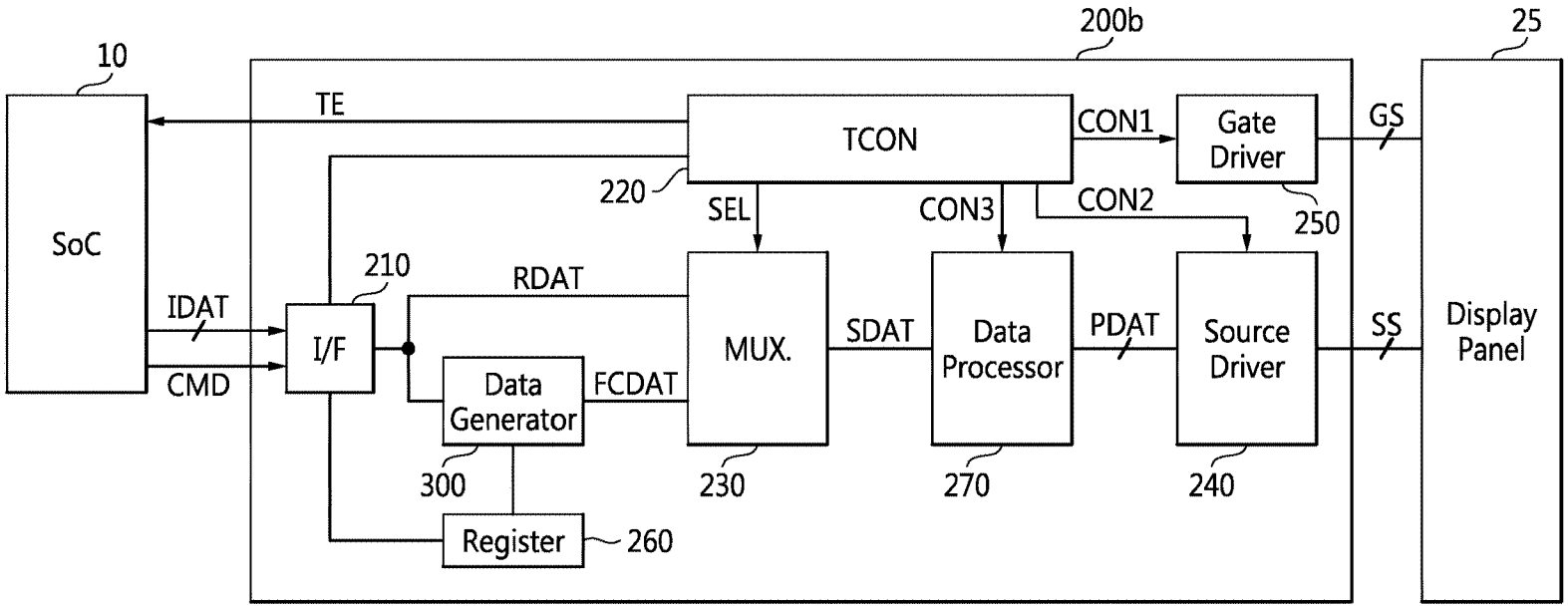
FIG. 3B is a block diagram of a modified example of the display driver illustrated in FIG. 3A according to one or more exemplary embodiments.

FIG. 3B is a block diagram of a modified example 200*b* of the display driver 200*a* illustrated in FIG. 3A. Because the structure and operations of the display driver 200*b* illustrated in FIG. 3B are similar to those of the display driver 200*a* illustrated in FIG. 3A, the description will be focused on the differences therebetween.

The display driver 200*b* illustrated in FIG. 3B further includes a data processor 270 as compared to the display driver 200*a* illustrated in FIG. 3A. The data processor 270 may perform image processing, for example, for reinforcement (such as extension, improvement, or enhancement) of an input image in order to increase the visual perception of an image to be displayed on the display panel 25. For instance, the data processor 270 may perform image processing like image reinforcement on the output data SDAT, and then output processed data PDAT to the source driver 240.

Figure 4:
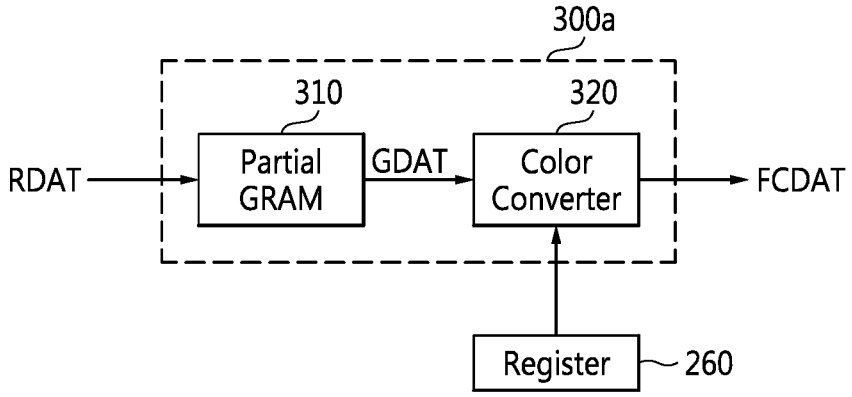
FIG. 4 is a block diagram of a converted data generator illustrated in FIGS. 3A and 3B according to one or more exemplary embodiments.

FIG. 4 is a block diagram of an example 300*a* of the converted data generator 300 illustrated in FIGS. 3A and 3B. Referring to FIG. 4, the converted data generator 300*a* includes a partial graphics RAM (GRAM) 310 and a color converter 320. The partial GRAM 310 stores m-bit data per pixel GDAT. The color converter 320 converts the m-bit data per pixel GDAT stored in the partial GRAM 310 into n-bit full color data per pixel to output the n-bit converted data FCDAT.

The register 260 may store at least one conversion data set. The conversion data set is data that defines mapping between m-bit data and n-bit converted data. The converted data may be set as a full color data value (e.g., RGB data) corresponding to each possible value of the m-bit data.

Figure 5:
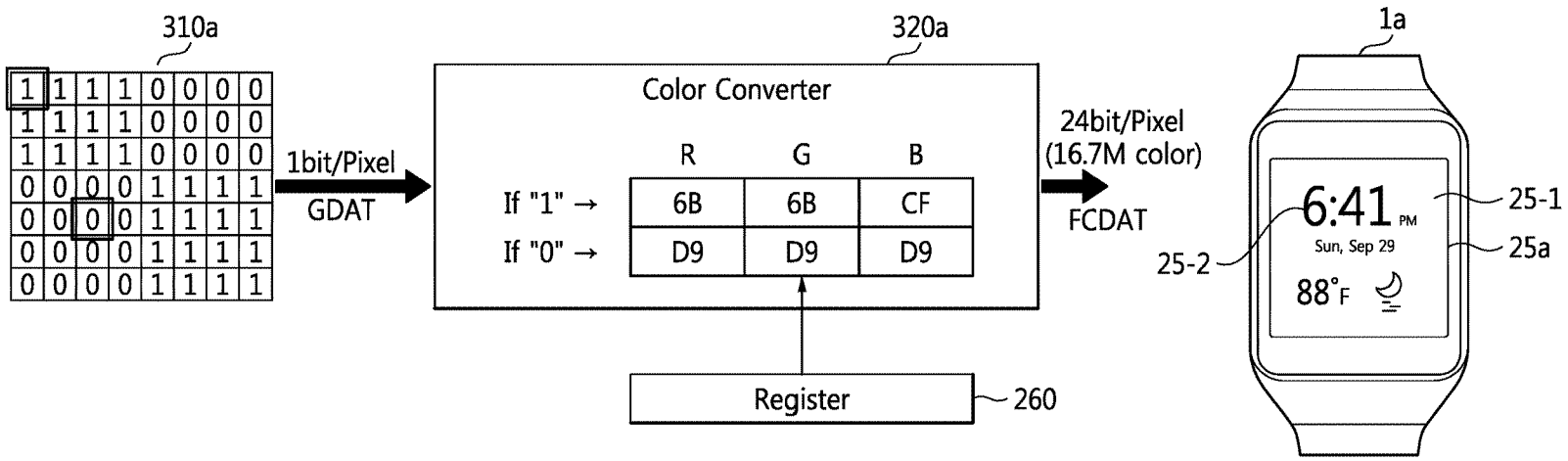
FIG. 5 is a diagram for explaining the operation of the converted data generator illustrated in FIG. 4 according to one or more exemplary embodiments.

FIG. 5 is a diagram for explaining the operation of the converted data generator 300*a* illustrated in FIG. 4 in a personal electronic device 1*a*, according to one or more exemplary embodiments. Referring to FIGS. 4 and 5, a partial GRAM 310*a* may store 1-bit data per pixel GDAT (where "m" is 1). The 1-bit data per pixel GDAT may have a value of "1" or "0".

A color converter 320*a* may receive the 1-bit data per pixel GDAT, may output first full color data (e.g., R=6B, G=6B, and B=CF) in a conversion data set defined in the register 260 when the 1-bit data per pixel GDAT is "1", and may output second full color data (e.g., R=D9, G=D9, and B=D9) in the conversion data set in the register 260 when the 1-bit data per pixel GDAT is "0". The full color data FCDAT may be 24-bit data per pixel, i.e., data composed of 8-bit R data, 8-bit G data, and 8-bit B data. However, exemplary embodiments are not restricted to the current exemplary embodiments.

The conversion data set (e.g., the first and second full color data) in the register 260 may be changed according to the command CMD of the SoC 10. For instance, the SoC 10 may newly set the conversion data set (e.g., the first and second full color data) or change a value in the register 260 using a register setting command.

The converted data FCDAT output from the color converter 320*a* is input to the source driver 240. The source driver 240 drives the display panel 25 based on the converted data FCDAT, so that an image of a color corresponding to the converted data FCDAT is displayed.

Accordingly, a color of a background 25-1 and a color of a non-background 25-2 in a display screen 25*a* can be set by a user, and can be changed by the user's setting. When the color of the background 25-1 and the color of the non-background 25-2 are changed according to a user's setting, the SoC 10 may change the conversion data set stored in the register 260 using the register setting command. As a result, the color of the background 25-1 and the color of the non-background 25-2 are changed on the display screen 25*a*.

Figure 6:
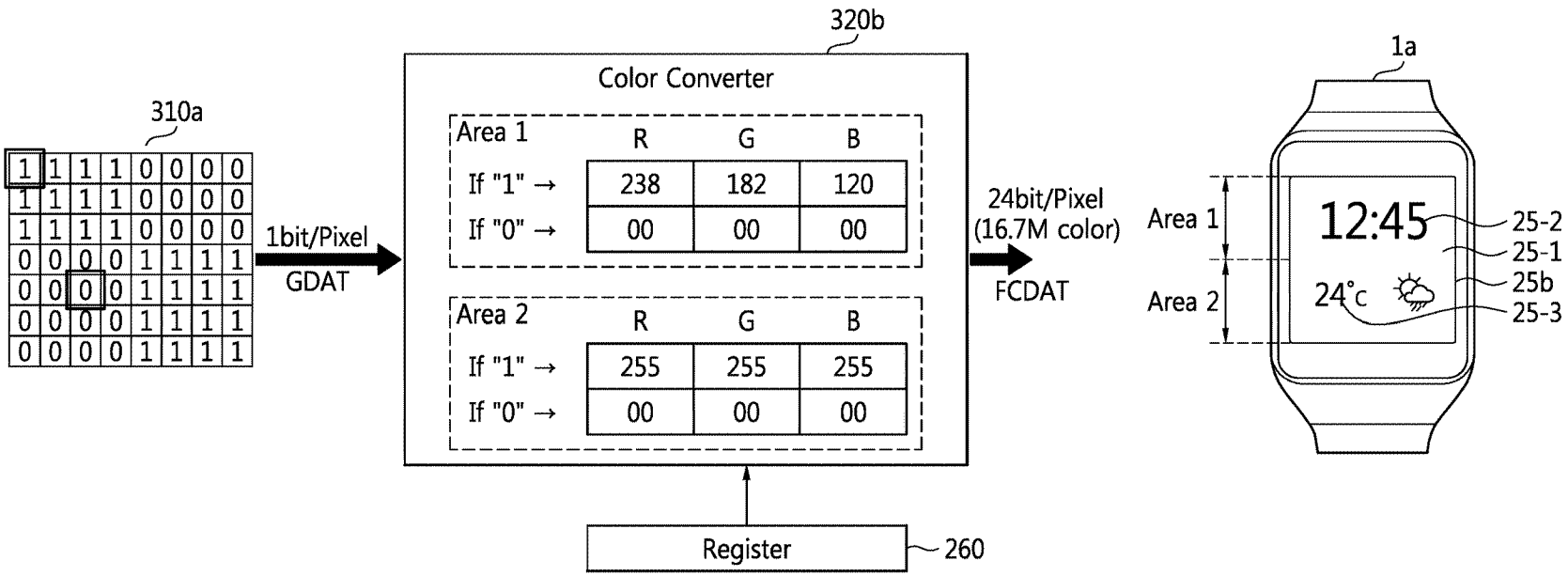
FIG. 6 is a diagram for explaining the operation of the converted data generator illustrated in FIG. 4 according to one or more exemplary embodiments.

FIG. 6 is a diagram for explaining the operation of the converted data generator 300*a* illustrated in FIG. 4 on a personal electronic device 1*a*, according to one or more exemplary embodiments. Referring to FIGS. 4 and 6, the partial GRAM 310*a* may store the 1-bit data per pixel GDAT (where "m" is 1). The 1-bit data per pixel GDAT may have a value of "1" or "0". The register 260 may store a plurality of conversion data sets corresponding to a plurality of display areas.

A color converter 320*b* may receive the 1-bit data per pixel GDAT and may generate the converted data FCDAT having a different value according to a display area to which the data GDAT belongs. For instance, the color converter 320*b* may output first full color data (e.g., R=238, G=182, and B=120) in a first conversion data set defined in the register 260 when the 1-bit data per pixel GDAT belongs to a first display area "Area 1" and has a value of "1". The color converter 320*b* may output second full color data (e.g., R=00, G=00, and B=00) in the first conversion data set defined in the register 260 when the 1-bit data per pixel GDAT belongs to the first display area "Area 1" and has a value of "0".

The color converter 320*b* may output third full color data (e.g., R=255, G=255, and B=255) in a second conversion data set defined in the register 260 when the 1-bit data per pixel GDAT belongs to a second display area "Area 2" and has a value of "1". The color converter 320*b* may output fourth full color data (e.g., R=00, G=00, and B=00) in the second conversion data set defined in the register 260 when the 1-bit data per pixel GDAT belongs to the second display area "Area 2" and has a value of "0".

As described above, a display screen 25*b* is divided into at least two display areas and different conversion data sets are defined for the respective display areas, so that a different color may be set for each display area.

Even when the background 25-1 corresponds to multiple display areas, the background 25-1 of the display screen 25*b* may be displayed in the same color by setting full color data values corresponding to "0" of each area to be the same. A non-background image in a different display area may be displayed in different colors by setting full color data values corresponding to 1 of each area to be different according to the display areas. For instance, when time 25-2 is displayed in the first display area "Area 1" and temperature 25-3 is displayed in the second display area "Area 2", as shown in FIG. 6; color in which the time 25-2 is displayed may be different from color in which the temperature 25-3 is displayed.

The partial GRAM 310*a* illustrated in FIGS. 5 and 6 stores 1-bit data per pixel, but according to one or more exemplary embodiments, it may store 2-, 3- or 4-bit data per pixel. In other words, the number of bits stored in GRAM per pixel may be changed.

As described above, according to one or more exemplary embodiments, full color data (i.e., n-bit-per-pixel data) is generated and displayed using the partial GRAM 310 having a small capacity which stores m-bit data per pixel, so that power consumption and cost can be reduced. In addition, color displayed by the full color data may be changed according to time or a display area, so that diversity and convenience for user can also be satisfied.

Figure 7:
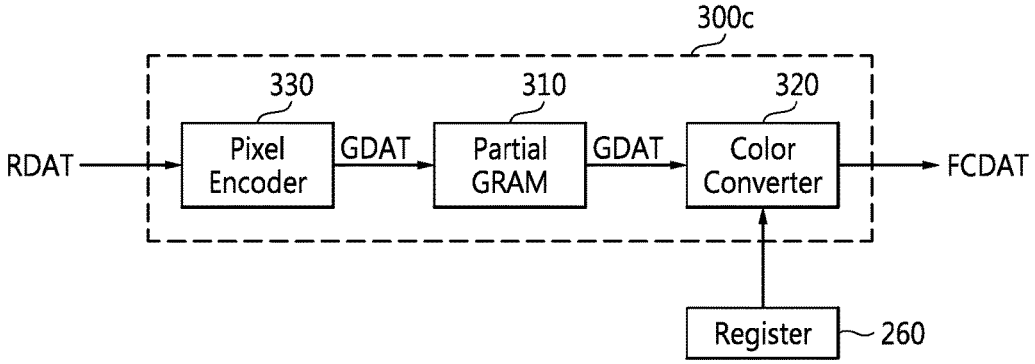
FIG. 7 is a block diagram of another example of the converted data generator illustrated in FIGS. 3A and 3B according to one or more exemplary embodiments.

FIG. 7 is a block diagram of another example 300*c* of the converted data generator 300 illustrated in FIGS. 3A and 3B, according to one or more exemplary embodiments. FIGS. 8A through 8C are diagrams for explaining the operation of the converted data generator 300*c* illustrated in FIG. 7, according to one or more exemplary embodiments. More particularly, FIG. 8A represent an exemplary embodiment of the received data RDAT input to the pixel encoder 330, FIG. 8B represent an exemplary embodiment of the encoded data GDAT stored in the partial GRAM 310, FIG. 8C represent an exemplary embodiment of the converted data FCDAT converted by the color converter 320. Referring to FIGS. 7, 8A, 8B, and 8C, the converted data generator 300*c* is different from the converted data generator 300*a* illustrated in FIG. 4 in that the converted data generator 300*c* further includes a pixel encoder 330. The differences between the converted data generators 300*c* and 300*a* will be focused in the description below to avoid redundancy.

The pixel encoder 330 may encode the received data RDAT into the m-bit data per pixel GDAT and store the m-bit data per pixel GDAT in the partial GRAM 310. The received data RDAT may be n-bit data per pixel.

The received data RDAT may be 24-bit data per pixel, i.e., data composed of 8-bit R data, 8-bit G data, and 8-bit B data. At this time, the pixel encoder 330 may convert the 24-bit data per pixel RDAT into the 2-bit data per pixel GDAT according to a predetermined data encoding rule.

For instance, as shown FIGS. 8A and 8B, the pixel encoder 330 may output "00" as the encoded data GDAT when R, G, and B data are all "00"; may output "11" as the encoded data GDAT when R, G, and B data are all "FF"; and may output "01" as the encoded data GDAT when not all of R, G, and B data are "00" or "FF". However, this is just an example of the data encoding rule of the pixel encoder 330 and exemplary embodiments are not restricted to this example. The data encoding rule of the pixel encoder 330 may be set or changed by a host.

The partial GRAM 310 stores the encoded data GDAT output from the pixel encoder 330. Consequently, the partial GRAM 310 stores the 2-bit data per pixel GDAT.

The color converter 320 may convert the 2-bit data per pixel GDAT stored in the partial GRAM 310 into 8-bit R, G, and B data referring to the register 260, thereby outputting the 24-bit converted data per pixel FCDAT (where "n"=24). For instance, as shown in FIGS. 8B and 8C, the color converter 320 may output "FF", "FF", and "FF" as the R, G, and B data when the encoded data GDAT is "11"; may output "00", "00", and "00" as the R, G, and B data when the encoded data GDAT is "00"; and may output "FF", "99", and "00" as the R, G, and B data when the encoded data GDAT is "01". However, a value of the converted data FCDAT mapped to each value of the encoded data GDAT may be changed. The value of the converted data FCDAT mapped to each value of the encoded data GDAT may be stored in the register 260. The register 260 may be set or changed in response to a register setting command of a host.

Figure 9:
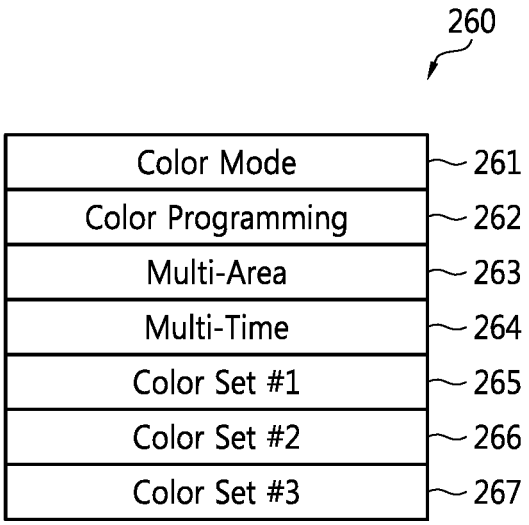
FIG. 9 is a diagram of a register according to one or more exemplary embodiments.

FIG. 9 is a diagram of the register 260 according to one or more exemplary embodiments. Referring to FIG. 9, the register 260 may include a color mode field 261, a color programming field 262, a multi-area field 263, a multi-time field 264, a first color set field 265, a second color set field 266, and a third color set field 267. The color mode field 261 indicates the number of bits per pixel in the image data IDAT transmitted by a host, i.e., the SoC 10 to the display driver 200. For instance, when the color mode field 261 is set to "11", the SoC 10 transmits the image data IDAT having 24 bits per pixel, i.e., 8-bit R, G, and B data. When the color mode field 261 is set to "10", the SoC 10 transmits the image data IDAT having 18 bits per pixel, i.e., 6-bit R, G, and B data. When the color mode field 261 is set to "01", the SoC 10 transmits the image data IDAT having 2 bits per pixel. When the color mode field 261 is set to "00", the SoC 10 transmits the image data IDAT having 1 bit per pixel. However, this is just an example. The number of bits of the color mode field 261 and the number of bits in the image data IDAT may be changed.

When the SoC 10 transmits the n-bit image data per pixel IDAT to the display driver 200, the display driver 200 may encode the received n-bit data per pixel into m-bit data per pixel and store the encoded data in the partial GRAM 310. When the SoC 10 transmits the m-bit image data per pixel IDAT, the display driver 200 may store the m-bit received data per pixel in the partial GRAM 310 without encoding it.

The color programming field 262 indicates whether a conversion data set can be changed. As described above, the conversion data set is a lookup table or a table which defines the mapping between the data GDAT and the converted data FCDAT. For instance, when the color programming field 262 is set to "1", the conversion data set can be changed by the command of a host. When the color programming field 262 is set to "0", it may be impossible to change the conversion data set that has been initially set. A plurality of conversion data sets may be defined so that different colors are used according to display areas or time periods.

The multi-area field 263 indicates whether to use different conversion data sets for multiple display areas. For instance, when the multi-area field 263 is set to "1, it may be possible to use different conversion data sets for multiple display areas. When the multi-area field 263 is set to "0", one conversion data set may be used for an entire display area. When the multi-area field 263 is set to "1", a field for defining the multiple display areas may be additionally set.

The multi-time field 264 indicates whether to use different conversion data sets for multiple time periods. For instance, when the multi-time field 264 is set to "1", it is possible to use different conversion data sets for multiple time periods. When the multi-time field 264 is set to "0", one conversion data set may be used for an entire time period. When the multi-time field 264 is set to "1", a field for defining the multiple time periods may be additionally set.

The first through third color set fields 265 through 267 are fields for storing a plurality of conversion data sets. According to the setting of the multi-area field 263 and the multi-time field 264, only the first color set field 265 may be used, or each of the first through third color set fields 265 through 267 may be used. More color sets may be used in addition to the first through third color set fields 265 through 267 in one or more exemplary embodiments.

FIGS. 10A through 10D are tables of conversion data sets according to one or more exemplary embodiments. FIG. 10A shows a conversion data set defining the mapping between m-bit data per pixel and n-bit data per pixel, where m=1. FIG. 10B shows a first conversion data set defining the mapping between m-bit data per pixel and n-bit data per pixel for the first display area "Area 1" and a second conversion data set defining the mapping between m-bit data per pixel and n-bit data per pixel for the second display area "Area 2", where m=1. FIG. 10C shows a conversion data set defining the mapping between m-bit data per pixel and n-bit data per pixel, where m=2. FIG. 10D shows a first conversion data set defining the mapping between m-bit data per pixel and n-bit data per pixel for a first time period "Time 1" and a second conversion data set defining the mapping between m-bit data per pixel and n-bit data per pixel for the second time period "Time 2", where m=1.

Figure 11:
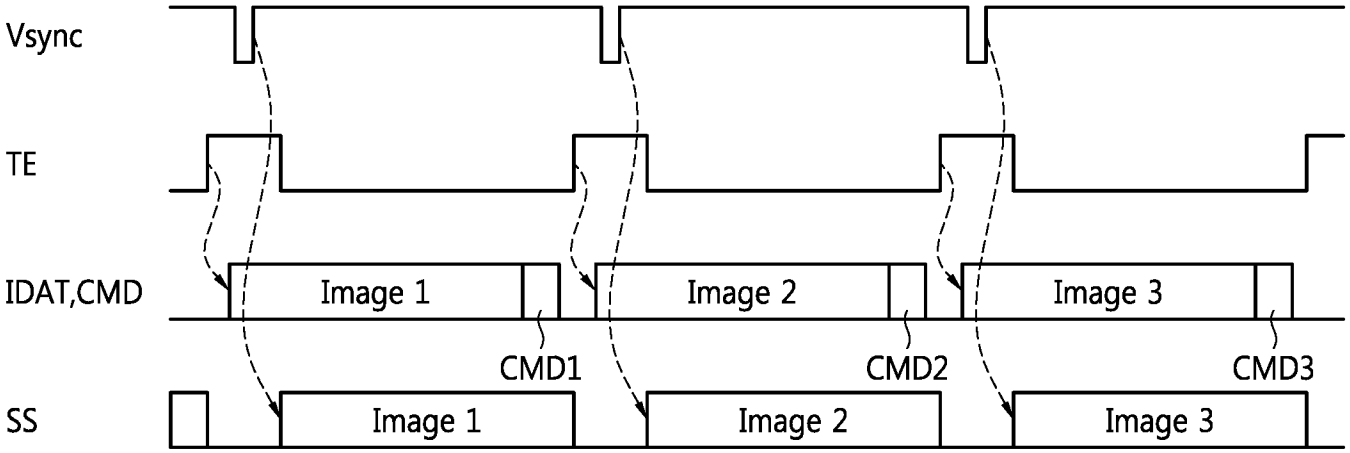
FIG. 11 is a timing chart of signals for explaining a method of operating a display driver according to one or more exemplary embodiments.

FIG. 11 is a timing chart of signals for explaining a method of operating a display driver according to one or more exemplary embodiments. The method illustrated in FIG. 11 may be performed by the display driver 200*a* or 200*b* illustrated in FIG. 3A or 3B.

Referring to FIG. 11, the display driver 200*a* or 200*b* generates a vertical synchronization signal Vsync for the synchronization of frame data. The display driver 200*a* or 200*b* may output the source data SS to the display panel 25 in response to the vertical synchronization signal Vsync.

The display driver 200*a* or 200*b* may output the reference signal TE for data transmission to the SoC 10. The SoC 10 may transmit the image data IDAT to the display driver 200*a* or 200*b* frame by frame in response to the reference signal TE of the display driver 200*a* or 200*b*. For instance, the SoC 10 may transmit first frame data "Image 1" to the display driver 200*a* or 200*b* in response to a rising edge of the reference signal TE. The display driver 200*a* or 200*b* may drive the display panel 25 using the source data SS based on the first frame data "Image 1" in response to a rising edge of the vertical synchronization signal Vsync. Alternatively, the display driver 200*a* or 200*b* may store m-bit data per pixel (where "m" is an integer of at least 1) in the partial GRAM 310 based on the first frame data "Image 1", may convert the m-bit data per pixel stored in the partial GRAM 310 into first n-bit converted data per pixel, and may drive the display panel 25 based on the first converted data. A first conversion data set used to convert m-bit data per pixel into the first n-bit converted data per pixel may be stored in the register 260 according to a register setting command of the SoC 10 before the display driver 200*a* or 200*b* receives the first frame data "Image 1".

The SoC 10 may transmit second frame data "Image 2" to the display driver 200*a* or 200*b* in response to a subsequent rising edge of the reference signal TE. The display driver 200*a* or 200*b* may drive the display panel 25 using the source data SS based on the second frame data "Image 2" in response to a subsequent rising edge of the vertical synchronization signal V sync.

The SoC 10 may transmit at least one register setting command CMD1, CMD2, or CMD3 to the display driver 200*a* or 200*b* after transmitting each of the first through third frame data "Image 1", "Image 2", and "Image 3". The register setting commands CMD1, CMD2, and CMD3 may be used to set or change a conversion data set. The display driver 200*a* or 200*b* sets the conversion data set in the register 260 in response to the register setting commands CMD1, CMD2, and CMD3.

According to the interface standard set between the SoC 10 and the display driver 200*a* or 200*b*, the SoC 10 may transmit the image data IDAT and the command CMD to the display driver 200*a* or 200*b* through one channel or through different channels, respectively. Accordingly, the register setting commands CMD1, CMD2, and CMD3 may have different transmission times.

When the conversion data set is changed in the register 260, the changed converted data set may be used for the color of subsequent frame data. For instance, when the display driver 200*a* or 200*b* changes the conversion data set in the register 260 in response to the register setting command CMD1, the changed conversion data set may be used starting with the second frame data "Image 2".

Figure 12:
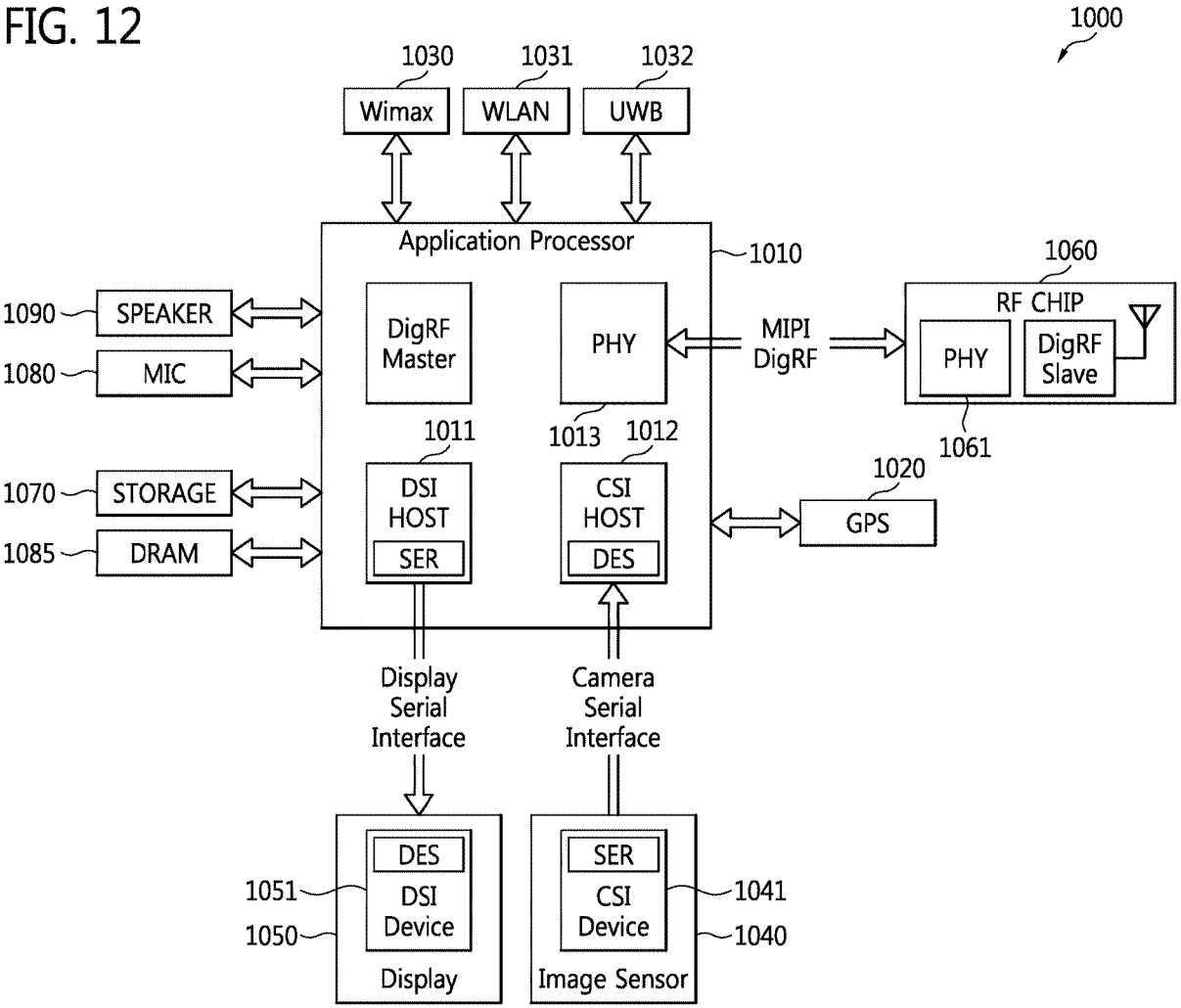
FIG. 12 is a block diagram of an electronic system including a display device according to one or more exemplary embodiments.

FIG. 12 is a block diagram of an electronic system 1000 including a display device 20 according to one or more exemplary embodiments. The electronic system 1000 may be implemented as a data processing apparatus, such as a mobile phone, a personal digital assistant (PDA), a portable media player (PMP), an Internet Protocol television (IP TV), or a smart phone that can use or support the MIN interface. The electronic system 1000 includes an application processor 1010, an image sensor 1040, and a display 1050.

A camera serial interface (CSI) host 1012 included in the application processor 1010 performs serial communication with a CSI device 1041 included in the image sensor 1040 through the CSI. For example, an optical de-serializer (DES) may be implemented in the CSI host 1012, and an optical serializer (SER) may be implemented in the CSI device 1041.

A display serial interface (DSI) host 1011 included in the application processor 1010 performs serial communication with a DSI device 1051 included in the display 1050 through DSI. For example, an optical serializer may be implemented in the DSI host 1011, and an optical de-serializer may be implemented in the DSI device 1051.

The electronic system 1000 may also include a radio frequency (RF) chip 1060 which communicates with the application processor 1010. A physical layer (PHY) 1013 of the electronic system 1000 and a PHY 1061 of the RF chip 1060 communicate data with each other according to a MIPI DigRF standard. The electronic system 1000 may further include at least one element among a GPS 1020, a storage device 1070, a microphone 1080, a DRAM 1085 and a speaker 1090. The electronic system 1000 may communicate using World Interoperability for Microwave Access (Wimax) 1030, Wireless LAN (WLAN) 1031, Universal Serial Bus (USB) or Ultra Wideband (UWB) 1032 etc.

Figure 13:
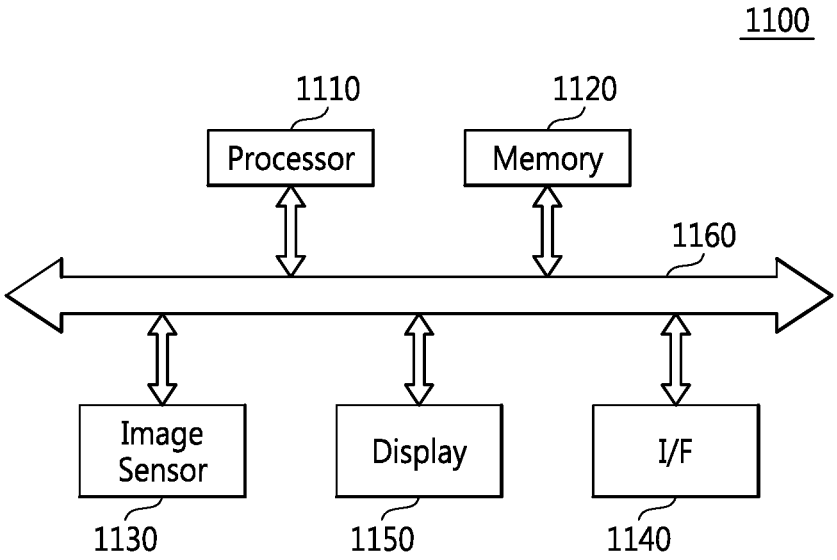
FIG. 13 is a block diagram of an image processing system including a display device according to one or more exemplary embodiments.

FIG. 13 is a block diagram of an image processing system 1100 including a display device according to one or more exemplary embodiments. Referring to FIG. 13, the image processing system 1100 may be implemented as a mobile phone, a personal digital assistant (PDA), a portable media player (PMP), an IP TV, a smart phone, or a wearable device (e.g., a smart watch), but is not restricted to them. The image processing system 1100 may include a processor 1110, a memory 1120, the image sensor 1130, a display unit 1050, and an I/F 1140.

The processor 1110 may control the operation of the image sensor 1130. The processor 1110 may determine whether a camera is in a predetermined mode (for example, a live-view mode or a preview mode) and control the image sensor 1130 to operate in a skip mode.

The memory 1120 may store a program for controlling the operation of the image sensor 1130 through a bus 1160 according to the control of the processor 1110 and may also store the image. The processor 1110 may access the memory 1120 and execute the program. The memory 1120 may be formed as a non-volatile memory.

The image sensor 1130 may operate in the skip mode or the normal mode, and generate image information, under the control of the processor 1110.

The display unit 1150 may receive the image from the processor 1110 or the memory 1120 and display the image on a display (e.g., a liquid crystal display (LCD) or an active-matrix organic light emitting diode (AMOLED) display). The I/F 1140 may be formed for the input and output of the two or three dimensional image. The I/F 1140 may be implemented as a wireless I/F.

As described above, according to one or more exemplary embodiments, a display driver implements full color (e.g., 24-bit-per-pixel data) using small-capacity GRAM. As a result, the power consumption of the display driver and a system including the display driver is reduced. Because the small-capacity GRAM is used, cost is also reduced.

While exemplary embodiments have been particularly shown and described, it will be understood by those of ordinary skill in the art that various changes in forms and details may be made therein without departing from the spirit and scope of the inventive concept as defined by the following claims.

What is claimed is:

1. A display driver comprising:

an interface circuit configured to receive n-bit image data from a host, n being an integer greater than zero;

a graphics memory configured to store m-bit data per pixel corresponding to the n-bit image data received by the interface circuit, m being an integer greater than zero and less than n;

a color converter configured to convert the m-bit data per pixel stored in the graphics memory into n-bit data per pixel and to output n-bit converted data;

a selector configured to output the n-bit converted data based on a selection signal indicating a first mode and output the n-bit image data received from the host based on the selection signal indicating a second mode; and a source driver configured to drive a display panel based on output data of the selector.

2. The display driver of claim 1, further comprising a register configured to store a register setting, wherein the color converter is further configured to convert the n-bit data according to the register setting.

3. The display driver of claim 1, wherein the color converter is further configured to output first predetermined RGB data as the n-bit converted data in response to the m-bit data per pixel being one, and output second predetermined RGB data as the n-bit converted data in response to the m-bit data per pixel being zero.

4. The display driver of claim 1, wherein integer m being one; and the color converter is further configured to output first predetermined RGB data as the n-bit converted data in response to the m-bit data per pixel being one and corresponding to a first area, output second predetermined RGB data as the n-bit converted data in response to the m-bit data per pixel being one and corresponding to a second area, output third predetermined RGB data as the n-bit converted data in response to the m-bit data per pixel being zero and corresponding to the first area, and output fourth predetermined RGB data as the n-bit converted data in response to the m-bit data per pixel being zero and corresponding to the second area.

5. The display driver of claim 1, further comprising a register configured to store at least one conversion data set which defines a mapping between the m-bit data per pixel and the n-bit converted data.

6. The display driver of claim 5, wherein the display driver is further configured to change the at least one conversion data set in the register in response to receiving a register setting command from the host.

7. The display driver of claim 5, wherein the at least one conversion data set comprises a first conversion data set of a plurality of conversion data sets corresponding to a first area of a plurality of display areas and a second conversion data set of the plurality of conversion data sets corresponding to a second area of the plurality of display areas.

8. The display driver of claim 5, wherein the at least one conversion data set comprises a first conversion data set of a plurality of conversion data sets corresponding to a first time period of a plurality of time periods and a second conversion data set of the plurality of conversion data sets corresponding to a second time period of the plurality of time periods.

9. The display driver of claim 5, wherein the register is further configured to store:

a color mode field indicating a number of bits per pixel in the n-bit image data; and a color programming field indicating whether the at least one conversion data set can be changed.

10. The display driver of claim 1, further comprising a pixel encoder configured to encode the n-bit image data received by the interface circuit into the m-bit data per pixel according to a predetermined encoding rule.

11. A display device comprising:

a display panel configured to display an image signal; and a display driver configured to drive the display panel, the display driver comprising:

an interface circuit configured to receive n-bit image data per pixel from a host, n being an integer greater than zero;

a converted data generator configured to generate n-bit converted data per pixel based on at least one conversion data set which defines a mapping between m-bit data and n-bit data, m being an integer greater than zero and less than n, and a source driver configured to drive the display panel based on the n-bit converted data while the display device is operating in a first mode and drive the display panel based on the n-bit image data received by the interface circuit while the display device is operating in a second mode, wherein a first conversion data set of the at least one conversion data set corresponds to one among a first time period of a plurality of time periods and a first display area of a plurality of display areas.

12. The display device of claim 11, wherein the display driver further comprises a register configured to store a plurality of conversion data sets, each of the plurality of conversion data sets corresponding to one among the plurality of time periods and the plurality of display areas.

13. The display device of claim 12, wherein a conversion data set of the plurality of conversion data sets is changed according to a register setting command of the host.

14. The display device of claim 12, wherein the converted data generator comprises:

a graphics memory configured to store the m-bit data per pixel; and a color converter configured to convert the m-bit data per pixel data into the n-bit converted data per pixel converted data according to a conversion data set of the plurality of conversion data sets.

15. The display device of claim 14, wherein the converted data generator further comprises a pixel encoder configured to encode the n-bit image data received by the interface circuit into the m-bit data per pixel according to a predetermined encoding rule.

16. The display device of claim 14, wherein m is selected from among one and two.

17. The display device of claim 14, wherein the plurality of display areas comprises a first area and a second area, and the register is further configured to store the first conversion data set corresponding to the first area and a second conversion data set corresponding to the second area.

18. A display driver comprising:

an interface circuit configured to receive n-bit image data from a host, n being an integer greater than zero;

a graphics memory configured to store m-bit data per pixel corresponding to the n-bit image data received from the host, m being an integer greater than zero and less than n;

a color converter configured to convert the m-bit data per pixel stored in the graphics memory into n-bit data per pixel and to output n-bit converted data;

a selector configured to output the n-bit converted data based on a selection signal indicating a first mode and output the n-bit image data received from the host based on the selection signal indicating a second mode;

a data processor configured to perform image processing on output data of the selector and generate a processed image signal; and a source driver configured to drive a display panel based on the processed image signal.

19. The display driver of claim 18, further comprising a pixel encoder configured to encode the n-bit image data received by the interface circuit into the m-bit data per pixel according to a predetermined encoding rule and output the m-bit data per pixel to the graphics memory.

* * * * *